US006698407B2

(12) United States Patent
Ikegawa

(10) Patent No.: US 6,698,407 B2
(45) Date of Patent: Mar. 2, 2004

(54) PIPE MECHANISM FOR EXHAUST GAS RECIRCULATION SYSTEM

(75) Inventor: Atsutoshi Ikegawa, Nagoya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/107,308

(22) Filed: Mar. 28, 2002

(65) Prior Publication Data

US 2002/0157719 A1 Oct. 31, 2002

(30) Foreign Application Priority Data

Mar. 28, 2001 (JP) ..... 2001-094394

(51) Int. Cl.[7] ..... F02M 25/07
(52) U.S. Cl. ..... 123/568.17; 123/184.61
(58) Field of Search ..... 123/568.17, 568.12, 123/184.61, 568.11; 285/187

(56) References Cited

U.S. PATENT DOCUMENTS 5,201,549 A * 4/1993 Davey ..... 285/423
5,425,347 A * 6/1995 Zinke, II ..... 123/568.11
5,433,183 A * 7/1995 Vansnick ..... 123/568.11
5,492,104 A * 2/1996 Elder et al. ..... 123/568.17
5,542,711 A * 8/1996 Vaudry ..... 123/568.17
6,173,701 B1 * 1/2001 Azuma ..... 123/568.17
6,293,265 B1 * 9/2001 Gagnon ..... 123/568.17

FOREIGN PATENT DOCUMENTS

JP 2582966 11/1996

OTHER PUBLICATIONS

Michael J. Bauhof et al., "Design of an EGR Interface for Thermoplastic Intake Manifolds," *SAE TECHNICAL PAPER SERIES*930086, Mar. 1–5, 1993, pp. 1–6.

* cited by examiner

*Primary Examiner*—Henry C. Yuen
*Assistant Examiner*—Arnold Castro
(74) *Attorney, Agent, or Firm*—Burns, Doane, Swecker & Mathis, LLP

(57) ABSTRACT

A pipe mechanism for an exhaust gas recirculation system includes a joint pipe connected to an exhaust pipe, an inner tube through which flows exhaust gas, and an outer tube. The inner tube has an upstream end and a downstream end, with the downstream end being located in the intake pipe. The outer tube has an upstream end connected with the joint pipe and a downstream end attached on the outer surface of the inner tube. The outer tube is located around the inner tube with a predetermined clearance between the inner and outer tubes.

11 Claims, 3 Drawing Sheets

PIPE MECHANISM FOR EXHAUST GAS RECIRCULATION SYSTEM

This application is based on and claims priority under 35 U.S.C. §119 with respect to Japanese Application No. 2001-094394 filed on Mar. 28, 2001, the entire content of which is incorporated herein by reference.

FIELD OF THE INVENTION

The present invention generally relates to a pipe mechanism. More particularly, the present invention pertains to a pipe mechanism for an exhaust gas recirculation system which returns a part of the exhaust gas of an internal combustion engine from an exhaust pipe into the intake pipe.

BACKGROUND OF THE INVENTION

An example of a known pipe mechanism for an exhaust gas recirculation system is disclosed in Japanese Patent No. 2582966. This known pipe mechanism has an inner tube and an outer tube, both of which have an upstream end and a downstream end. Both of the downstream end portions are connected to each other, and the downstream end portions are inserted into the intake pipe of the internal combustion engine. The upstream end portion of the inner tube is connected with an exhaust pipe so that a part of the exhaust gas flows from the exhaust pipe into the inner tube. A predetermined clearance exists between the outer circumference of the inner tube and the inner circumference of the outer tube. The upstream end portion of the outer tube forms an opening to introduce fresh air into the predetermined clearance. Thus, the predetermined clearance acts as a heat insulating wall to cool the exhaust gas in the inner tube.

However, the upstream end portion of the inner tube is connected with the exhaust pipe, and the outer circumference of the outer tube is connected with the intake pipe. These connecting portions and the connection between the inner tube and the outer tube receive concentrated stress in the known pipe mechanism. Thus, in the known pipe mechanism, the connecting portions and the connection have to be sufficiently strong to withstand the stress.

If the thickness of both the inner tube and the outer tube is increased to increase the strength for purposes of withstanding the stress, the heat conduction of the inner and outer tubes is improved. The heat of the exhaust gas in the inner tube will be transferred to the outer tube. However, this is not desirable because the outer tube is attached to the intake pipe which is made of resin. If the outer tube is heated, the heat resistance of the intake pipe has to be improved. Therefore, increasing the thickness of both the inner tube and the outer tube can create other problems.

In addition, because the inner tube is fixed to the exhaust pipe in the known pipe mechanism, the heat in the exhaust pipe is transferred to the intake pipe via the inner tube. Thus, another problem exists in that the intake air may be excessively heated.

SUMMARY OF THE INVENTION

According to one aspect, a pipe mechanism for an exhaust gas recirculation system includes a joint pipe connected to an exhaust pipe, an inner tube through which flows exhaust gas and an outer tube. The outer tube has an upstream end and a downstream end, with the downstream end being positioned in an intake pipe. The outer tube has an upstream end connected with the joint pipe and a downstream end attached to the outer surface of the inner tube. The outer tube is located around the inner tube with a predetermined clearance.

According to another aspect, a pipe mechanism in an exhaust gas recirculation system includes a joint pipe connected to an exhaust pipe, a main pipe positioned between the joint pipe and an intake pipe, with the main pipe being comprised of an inner tube through which exhaust gas is adapted to flow and an outer tube. The inner surface of the outer tube faces the outer surface of the inner tube, and the inner surface of the outer rube is spaced from the outer surface of the inner tube over at least a portion of the length of the main pipe to provide a clearance. The inner and outer tubes each having an upstream end portion and a downstream end portion, with the downstream end portion of the inner tube being connected to the downstream end portion of the outer tube at a connection portion. The upstream end portion of the outer tube is connected to the joint pipe.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
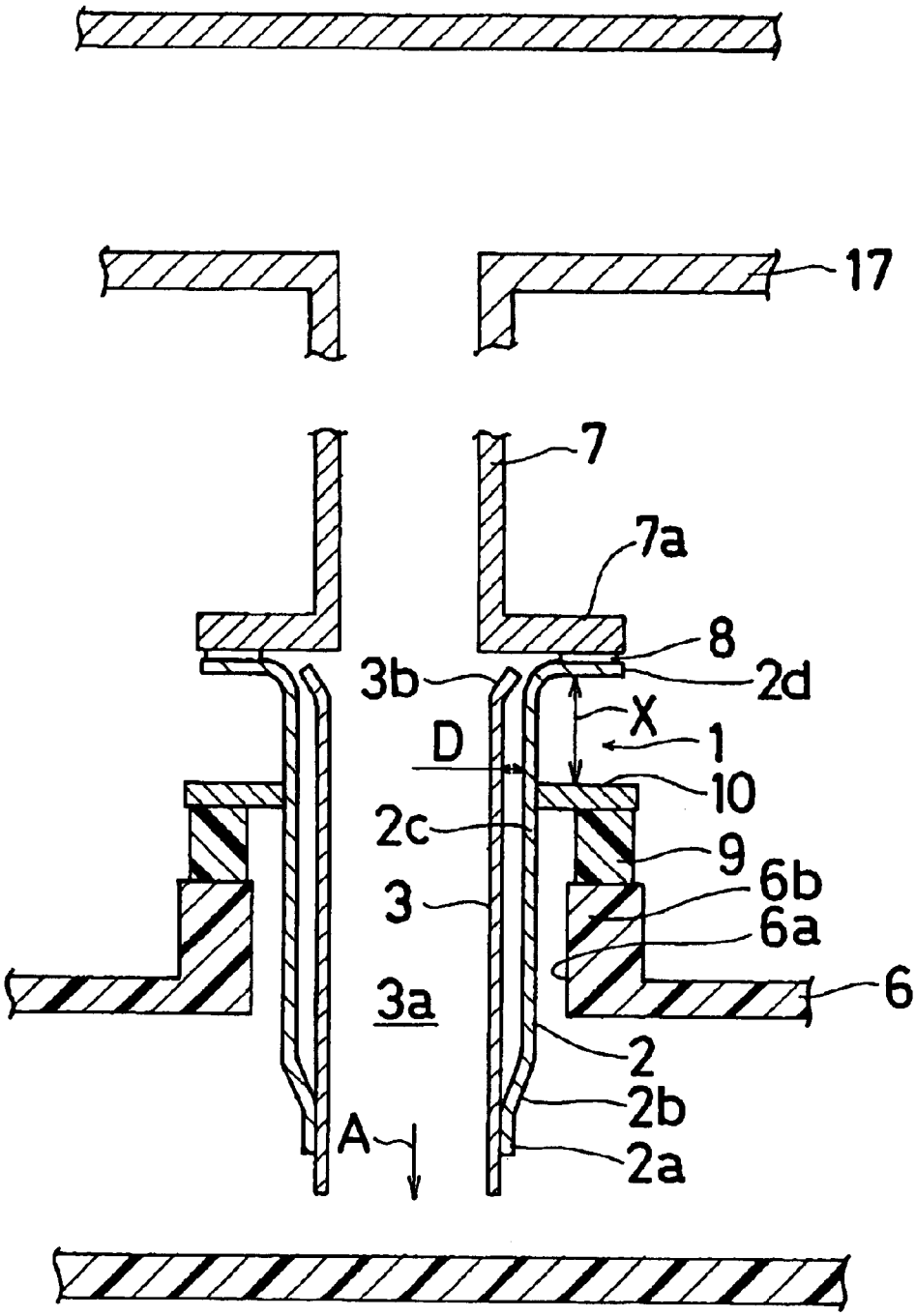
FIG. 1 is a vertical cross-sectional view of a first embodiment of a pipe mechanism in accordance with the prevent invention.
Figure 2:
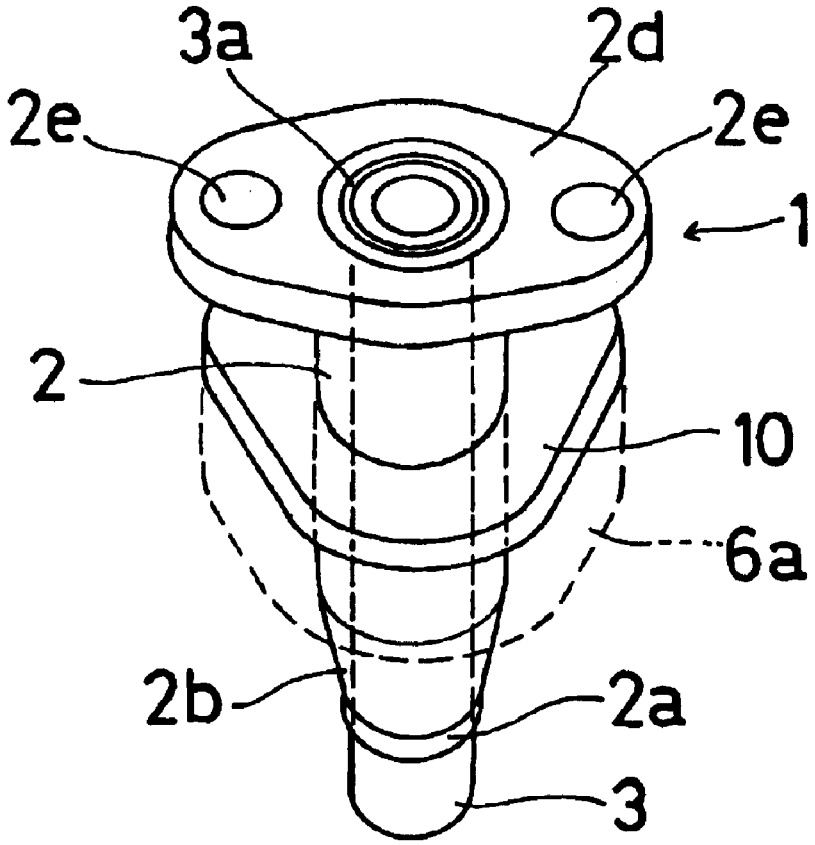
FIG. 2 is a perspective view of the pipe mechanism shown in FIG. 1.

One embodiment of a pipe mechanism for an exhaust gas recirculation system is shown in FIGS. 1 and 2 and includes a main pipe 1. The main pipe 1 is comprised of an outer tube 2 and an inner tube 3. The outer tube 2 and the inner tube 3 each have an upstream end and a downstream end. In this embodiment, exhaust gas flows in the inner tube 3 with the direction of flow being represented by the arrow A in FIG. 1. Thus, the upstream ends of the outer tube 2 and the inner tube 3 are located at the upper side in FIG. 1, and the downstream ends of the outer tube 2 and the inner tube 3 are located at the lower side in FIG. 1.

The outer tube 2 is located around or positioned in surrounding relation to the inner tube 3. The outer tube 2 has a connecting portion 2*a* located at the downstream end of the outer tube 2, providing a connection between the outer tube 2 and the inner tube 3. The outer tube 2 has a tapered portion 2*b* located adjacent the connecting portion 2*a* so that the diameter of the inner circumference of the outer tube 2 gradually tapers to the same diameter as the outer circumference of the inner tube 3. The outer tube 2 also includes a cylindrical portion 2*c* between the taper portion 2*b* and the upstream end of the outer tube 2. The diameter of the inner circumference of the cylindrical portion 2*c* is a predetermined diameter greater than the diameter of the outer circumference of the inner tube 3. A clearance D thus exists between the outer tube 2 and the inner tube 3 in the region of the cylindrical portion 2*c*.

The inner tube 3 possess a cylindrical shape. The downstream end of the inner tube 3 projects from the connection portion 2*a* of the outer tube 2. The inner tube has a passage 3*a* through which flows the exhaust gas from an exhaust pipe 17 to an intake pipe 6. The downstream end of the inner tube 3 is inserted into or extends into the intake pipe 6.

The upstream end of the outer tube 2 is provided with a first flange 2*d* which is integrally formed and in one piece with the outer tube 2. The first flange 2*d* is bent outwardly so that the diameter of the first flange 2*d* is enlarged. As shown in FIG. 2, the flange 2*d* has two tapped holes 2*e*.

As shown in FIG. 1, the upstream end of the inner tube 3 has an outwardly directed taper portion 3*b* so that exhaust gas flows relatively smoothly into the passage 3*a*. The upstream end of the inner tube 3 does not contact any other members, for example, the outer tube 2 or a joint pipe 7. Thus, the clearance D is always in communication with the passage 3*a*. Here, the joint pipe 7 is a part of the exhaust pipe 17 and is in communication with the exhaust pipe 17.

The first flange 2*d* of the outer tube 2 is fixed to a flange portion 7*a* of the joint pipe 7 by way of two bolt which are positioned in the tapped holes 2*e*, 2*e*. A seal member 8 constituting a connecting member is positioned between the first flange 2*d* of the outer tube 2 and the flange portion 7*a* of the joint pipe 7 to provide a fluid-tight connection between the first flange 2*d* of the outer tube 2 and the flange portion 7*a* of the joint pipe 7.

A second sealing flange 10 is provided on the outer circumference of the outer tube 2. The first flange 2*d* and the second flange 10 are parallel to each other and spaced apart by a distance X. The second flange 10 is fixed to the outer circumference of the outer tube 2 by brazing so as to be connected in a fluid-tight manner to the outer circumference of the outer tube 2.

The intake pipe 6 is a pipe that supplies air into combustion chambers of the internal combustion engine. The intake pipe 6 has an opening 6*a* through which extends the main pipe 1. The intake pipe 6 also includes a flange 6*b* located around and extending from the opening 6*a* in a direction away from the intake pipe 6. The diameter of the opening 6*a* is larger than that of the outer circumference of the outer tube 2. The second flange 10 is fixed to the flange 6*b* via a gasket 9 by way of bolts. The gasket 9, constituting a connecting member, is made of a heat insulation and heat resisting material, for example rubber-covered phenolic resin. The main pipe 1 is thus attached in an air-tight manner to the intake pipe 6.

The operation of the pipe mechanism described above is as follows. The exhaust gas for the exhaust gas recirculation is guided from the exhaust pipe 17 into the intake pipe 6 via the joint pipe 7 and the main pipe 1. In the main pipe 1, the exhaust gas is guided into the passage 3*a* of the inner tube 3. When the exhaust gas flows in the passage 3*a*, heat in the exhaust gas is transferred to the inner tube 3. By virtue of the air layer provided by the clearance D between the outer tube 2 and the inner tube 3, relatively little hear transfer occurs between the inner tube 3 and the outer tube 2 via the clearance D. The heat transferred to the inner tube 3 is transferred to the outer tube 2 via the connecting portion 2*a* of the outer tube 2. Because the connecting portion 2*a* is positioned in the intake pipe 6, the intake air cools the heated downstream portion of the outer tube 2. Thus, the heat transferred from the exhaust gas to the second flange 10 is relatively small. Therefore, the length of the outer tube 2, the diameter of the outer tube 2 and the position of the connection portion 2*a* controls the heat transferred from the exhaust gas to the flange portion 10 so that the transferred heat is cooler than the heat resistance temperature of the intake pipe 6.

With respect to the heat transfer associated with the exhaust gas flowing in the joint pipe 7, the exhaust gas transfers heat to the joint pipe 7. There is additional heat which is transferred from the exhaust gas to the main pipe 1 via the joint pipe 7, the flange portion 7*a* of the joint pipe 7 and the first flange 2*d* of the outer tube 2. The additional heat is transferred to the outer tube 2 as the flange portion 7*a* of the joint pipe 7 is connected to the first flange 2*d* of the outer tube 2. The additional heat will be transferred to the second flange 10. However, because the first flange 2*d* of the outer tube 2, the portion of the outer tube 2 designated by the distance "X", and the second flange 10 are exposed to air, the additional heat will be transferred to air so that the total additional heat will be relatively small. Here, the gasket 9 is made of a heat insulation and heat resisting material so that the intake pipe 6 will not be significantly heated. Further, if the temperature of the additional heat is higher than the temperature at the connecting portion 2*a*, the additional heat is transferred to the connecting portion 2*a* so that the second flange 10 is kept relatively cool.

The heat radiation ability for transferring to the intake air of the outer tube 2 is dependent on the axial length of the outer tube 2, the diameter of the outer tube 2 and the length of the outer tube 6 that is inserted within the intake pipe 6.

Because the inner tube 3 is not connected to the joint pipe 7, the heat in the joint pipe 7 is not transferred to the inner tube 3. Thus, the two parts of the heat radiations of the main pipe 1 work effectively. In other words, the heat in the inner tube 3 is transferred to the intake air, and the heat over the X-length portion of the outer tube 2 provided with the flanges 2*d* and 10 is transferred to the air. The heat transfer ability of the inner tube 3 can thus be relatively small. Therefore, the main pipe 1 can be made relatively small. More particularly, the diameter or the length of the outer tube 2 and/or the inner tube 3 can be reduced, thus make such parts lighter.

The main pipe 1 is connected between the joint pipe 7 and the intake pipe 6. Stress which may occur by virtue of vibration of the exhaust pipe 17 acts on the outer tube 2 between the first flange 2*d* and the second flange 10. Thus, making this portion of the outer tube 2 sufficiently strong helps ensure adequate installation strength of the main pipe 1. Here, the first flange 2*d*, the second flange 10 and the X-length portion of the outer tube 2 are located outside of the intake pipe 6. Thus, if the wall thickness and/or diameter of these portions is increased, space problems associated with installation of the main pipe do not arise. Further, this structure is quite desirable from the standpoint of heat radiation.

Figure 3:
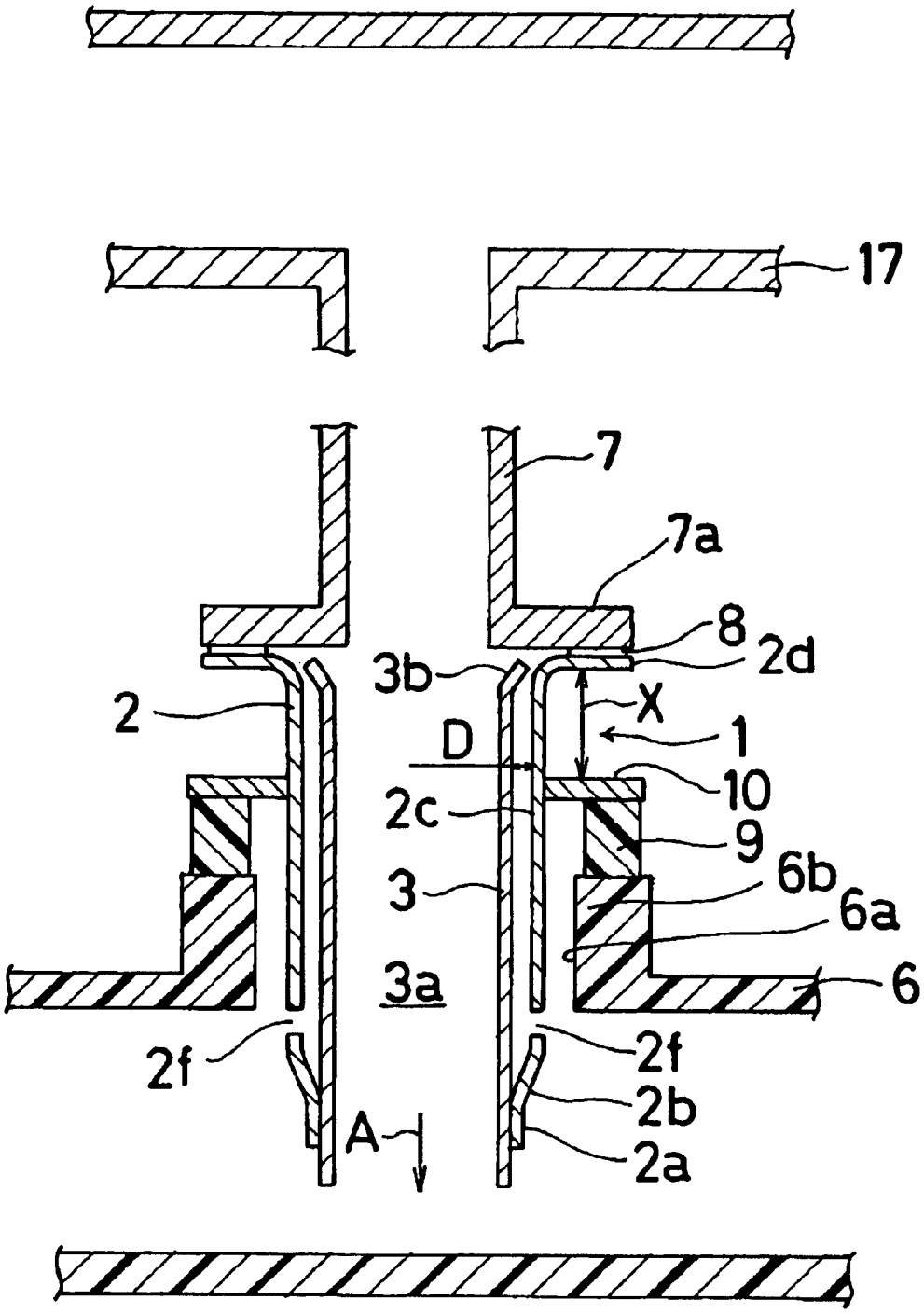
FIG. 3 is a vertical cross-sectional view of a second embodiment of the pipe mechanism.

FIG. 3 illustrates a second embodiment of the pipe mechanism for exhaust gas recirculation system. In this second embodiment, features or parts corresponding to those in the first embodiment are identified by the same reference numerals. A detailed description of such features will not be repeated here.

As shown in FIG. 3, two holes 2*f* are formed on the outer tube 2 so that a part of the intake air is introduced into the clearance D. Thus, the temperature in the clearance D is kept relatively cool and the heat radiation ability of the connection portion between the outer tube 2 and the inner tube 3 is relatively high. To achieve a desirable higher heat radiation, it is preferable that the two holes 2*f* are arranged along the flowing direction of the intake air.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A pipe mechanism for an exhaust gas recirculation system comprising:

a joint pipe connected to an exhaust pipe, an inner tube through which exhaust gas is adapted to flow, the inner tube having an upstream end and a downstream end, the downstream end of the inner tube being positioned in an intake pipe;

an outer tube having an upstream end connected to the joint pipe and a downstream end attached to the outer surface of the inner tube, the outer tube being located around the inner tube with a clearance between the inner tube and the outer tube, a first connecting member connecting the outer tube to the joint pipe, and a second connecting member connecting the outer tube to the intake pipe;

wherein an outer surface of the outer tube between the first connecting member and the second connecting member is exposed to air.

2. The pipe mechanism for an exhaust gas recirculation system according to claim 1, wherein the outer tube has a first hole for introducing intake air in the intake pipe into the clearance between the inner tube and the outer tube.

3. The pipe mechanism for an exhaust gas recirculation system according to claim 1, wherein the outer tube has another hole for discharging air from the predetermined clearance.

4. The pipe mechanism for an exhaust gas recirculation system according to claim 1, wherein the upstream end of the inner tube contacts neither the joint pipe nor the outer tube.

5. The pipe mechanism for an exhaust gas recirculation system according to claim 1, wherein the downstream end of the outer tube is positioned in the intake pipe.

6. A pipe mechanism in an exhaust gas recirculation system comprising:

a joint pipe connected to an exhaust pipe, a main pipe positioned between the joint pipe and an intake pipe of the exhaust gas recirculation system, the main pipe being comprised of an inner tube through which exhaust gas is adapted to flow and an outer tube, the outer tube having an inner surface and the inner tube having an outer surface;

the inner surface of the outer tube facing the outer surface of the inner tube, with the inner surface of the outer tube being spaced from the outer surface of the inner tube over at least a portion of the length of the main pipe to provide a clearance;

the inner and outer tubes each having an upstream end portion and a downstream end portion;

the downstream end portion of the inner tube extending into the intake pipe;

the upstream end portion of the inner tube being unconnected to the joint pipe;

the downstream end portion of the inner tube being connected to the downstream end portion of the outer tube at a connection portion;

the upstream end portion of the outer tube being connected to the joint pipe, wherein the upstream end portion of the outer tube is connected to the joint pipe by way of a seal member, and wherein the outer tube is connected to the intake pipe by way of a flange extending outwardly from an outer surface of the outer tube at a position spaced from the upstream end portion of the outer tube; and wherein the outer surface of the outer tube between the flange and the upstream end portion of the outer tube is exposed to air.

7. The pipe mechanism for an exhaust gas recirculation system according to claim 6, wherein the outer tube is provided with a plurality of holes communicating the clearance with the intake pipe.

8. The pipe mechanism for an exhaust gas recirculation system according to claim 6, wherein the upstream end portion of the inner tube is spaced from the joint pipe and is provided with an outward taper to define a gap between the outward taper and the joint pipe.

9. The pipe mechanism for an exhaust gas recirculation system according to claim 6, wherein the upstream end portion of the inner tube is outwardly tapered and spaced from the upstream end portion of the outer tube.

10. The pipe mechanism for an exhaust gas recirculation system according to claim 6, wherein the flange is connected to the intake pipe by way of a gasket.

11. The pipe mechanism for an exhaust gas recirculation system according to claim 6, wherein the downstream end portion of the outer tube is connected to an outer surface of the inner tube at the connection portion.

* * * * *